US009457920B2

(12) United States Patent
Hammad

(10) Patent No.: US 9,457,920 B2
(45) Date of Patent: Oct. 4, 2016

(54) AUTOMATED FOOD SAVER MACHINE

(75) Inventor: Jamal Hammad, Boynton Beach, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 447 days.

(21) Appl. No.: 14/126,692

(22) PCT Filed: Jun. 15, 2012

(86) PCT No.: PCT/US2012/042602

§ 371 (c)(1),
(2), (4) Date: Dec. 16, 2013

(87) PCT Pub. No.: WO2012/174339

PCT Pub. Date: Dec. 20, 2012

(65) Prior Publication Data

US 2014/0116003 A1 May 1, 2014

Related U.S. Application Data

(60) Provisional application No. 61/498,052, filed on Jun. 17, 2011.

(51) Int. Cl.
*B65B 7/06* (2006.01)
*B65B 31/04* (2006.01)
(Continued)

(52) U.S. Cl.
CPC ..... *B65B 7/06* (2013.01); *B65B 31/04* (2013.01); *B65B 31/048* (2013.01); *B65B 41/16* (2013.01); *B65B 43/04* (2013.01); *B65B 59/04* (2013.01)

(58) Field of Classification Search
CPC ..... B65B 51/146; B65B 31/04; B65B 31/43; B65B 31/48; B65B 31/06; B65B 7/02; B65B 7/06; B65B 43/12; B65B 43/123; B65B 43/14; B65B 43/22
USPC ..... 53/512, 510, 79, 374.8, 374.9, 389.2, 53/389.3
See application file for complete search history.

(56) References Cited

U.S. PATENT DOCUMENTS 3,764,434 A * 10/1973 Bridenstine ..... B29C 66/861 156/251
5,858,164 A * 1/1999 Panjwani ..... B29C 65/20 100/33 PB (Continued)

FOREIGN PATENT DOCUMENTS

JP 03069415 3/1991
WO 2004076283 9/2004
WO WO 2015134764 A1 * 9/2015 ..... B65B 31/02

*Primary Examiner* — Hemant M Desai
*Assistant Examiner* — Dariush Seif
(74) *Attorney, Agent, or Firm* — Michael J. Corrigan

(57) ABSTRACT

A food storage machine is provided that includes a film delivery mechanism, a cutting mechanism, a conditioning assembly and a drive mechanism. The film delivery mechanism has a support cradle for a roll of bag material and a feed roller assembly for dispensing the bag material. The cutting mechanism is disposed adjacent the film delivery mechanism and has a first sealing bumper and a shuttle member with a cutting portion. The shuttle member is arranged to cut transversely across the bag material dispensed from the film delivery mechanism. The conditioning assembly is pivotably disposed below the film delivery mechanism and has a heater member for sealing a portion of the bag material. The drive mechanism is operatively connected to the conditioning assembly and configured to pivot upwards to contact the first sealing bumper of the cutting mechanism and to pivot downwards to contact a second sealing bumper.

18 Claims, 18 Drawing Sheets

(51) Int. Cl.

| | |
|---|---|
| ***B65B 41/16*** | (2006.01) |
| ***B65B 43/04*** | (2006.01) |
| ***B65B 59/04*** | (2006.01) |

(56) References Cited

U.S. PATENT DOCUMENTS

| | | | | |
|---|---|---|---|---|
| 6,694,710 | B2 | 2/2004 | Wang | |
| 7,000,369 | B1 * | 2/2006 | Paviot | B65B 9/13 493/189 |
| 7,454,884 | B2 | 11/2008 | Kahn et al. | |
| 2004/0060262 | A1 | 4/2004 | Harges et al. | |
| 2005/0011166 | A1 | 1/2005 | Germano | |
| 2007/0039288 | A1 * | 2/2007 | Clarke | B65B 31/08 53/434 |
| 2010/0095638 | A1 * | 4/2010 | Zakowski | B65B 51/148 53/433 |
| 2013/0097967 | A1 * | 4/2013 | Picozza | B65B 31/04 53/408 |

* cited by examiner

AUTOMATED FOOD SAVER MACHINE

CROSS-REFERENCE TO RELATED APPLICATIONS

This application claims priority under 35 U.S.C. §119(e) to U.S. Provisional Patent Application No. 61/498,052 filed on Jun. 17, 2011. The entire disclosure of U.S. Provisional Patent Application No. 61/498,052 is hereby incorporated herein by reference.

BACKGROUND OF THE INVENTION

1. Field of the Invention

The present invention generally relates to a food storage machine. More specifically, the present invention relates to a food storage machine for dispensing, evacuating and sealing bag material.

2. Background Information

Vacuum packaging appliances that evacuate air from containers holding food are becoming increasingly popular with households for food preservation and storage. The removal of the air delays spoilage and extends the life of the food. The appliances are typically used in conjunction with bag material that constitutes the container holding the food. The bag material includes two stacked layers of thin, and optionally transparent, plastic film that are sealed together on lateral edges. A length of the bag material that is suitable to hold the food is cut into the desired length with a blade, for example. One of the cut edges of the bag material is sealed by applying heat and pressure to the cut edge to form a storage bag. After the food is inserted in the storage bag, the storage bag is fully sealed by applying heat and pressure to the remaining cut edges. Thus, the ends of the bag material that are cut (i.e. the transverse ends) are sealable to form a fully sealed bag. A vacuum may be applied to evacuate air from the storage bag before it is fully sealed.

In view of the above, it will be apparent to those skilled in the art from this disclosure that there exists a need for an improved food storage machine that controllably dispenses, evacuates and seals bag material. This invention addresses this need in the art as well as other needs, which will become apparent to those skilled in the art from this disclosure.

SUMMARY OF THE INVENTION

A food storage machine is provided that basically comprises a film delivery mechanism, a cutting mechanism, a conditioning assembly and a drive mechanism. The film delivery mechanism has a support cradle for a roll of bag material and a feed roller assembly for dispensing the bag material. The feed roller assembly is disposed adjacent the support cradle. The cutting mechanism is disposed adjacent the film delivery mechanism and has a first sealing bumper and a shuttle member with a cutting portion. The shuttle member is arranged to cut transversely across the bag material dispensed from the film delivery mechanism. The conditioning assembly is pivotably disposed below the film delivery mechanism and having a heater member for sealing a portion of the bag material. The drive mechanism is operatively connected to the conditioning assembly and configured to pivot upwards to contact the first sealing bumper of the cutting mechanism and to pivot downwards to contact a second sealing bumper.

In another embodiment, a food storage machine is provided that basically comprises a film delivery mechanism, a cutting mechanism, a conditioning assembly, a housing and a removable tray. The film delivery mechanism has a support cradle for a roll of bag material and a feed roller assembly for dispensing the bag material. The feed roller assembly is disposed adjacent the support cradle. The cutting mechanism is disposed adjacent the film delivery mechanism and has a shuttle member with a cutting portion. The shuttle member is arranged to cut transversely across the bag material dispensed from the film delivery mechanism. The conditioning assembly is pivotably disposed below the film delivery mechanism and has a heater member for sealing a portion of the bag material. The housing has at least one slot sized for the bag material and a receptacle cavity with its opening at a front side of the housing. The removable tray is slidably positioned in the receptacle cavity and configured to slide out of the receptacle cavity from the front side of the housing.

In yet another embodiment, a food storage machine is provided that basically comprises a film delivery mechanism, a cutting mechanism, a conditioning assembly, a housing and a vacuum remote assembly. The film delivery mechanism has a support cradle for a roll of bag material and a feed roller assembly for dispensing the bag material. The feed roller assembly is disposed adjacent the support cradle. The cutting mechanism is disposed adjacent the film delivery mechanism and has a shuttle member with a cutting portion. The shuttle member is arranged to cut transversely across the bag material dispensed from the film delivery mechanism. The conditioning assembly is pivotably disposed below the film delivery mechanism and has a heater member for sealing a portion of the bag material. The housing has at least one slot sized for the bag material, a remote cavity with its opening at a front side of the housing, and an inner cavity. The vacuum remote assembly has a hose member coiled in the inner cavity of the housing, a nozzle member and an adapter member. The nozzle member and the adapter member are removably disposed in the remote cavity.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

An automated food storage machine 1 is provided that dispenses and seals a bag material 2 in fewer steps while providing integrated storage for rolls of bag material. A user has control over dispensing bag material 2 and less is wasted. The food storage machine 1 also simplifies vacuum sealing the bag material 2 and improves user access to dispensing, evacuating and sealing functions. The food storage machine 1 is structured for stability on a countertop and compact for movement or storage. In addition, the food storage machine 1 has an interior that is easy to maintain and clean.

Figure 1:
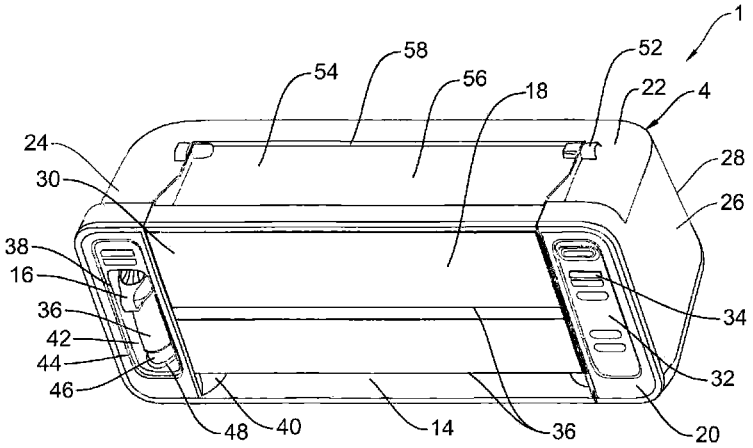
FIG. 1 is a front perspective view of a food storage machine according to an embodiment of the present invention.

Referring initially to FIG. 1, the food storage machine 1 is illustrated in accordance with a first embodiment of the present invention. The food storage machine 1 includes a housing 4, a film delivery mechanism 6, a cutting mechanism 8, a conditioning (heater and vacuum) assembly 10, a drive mechanism 12, a removable tray 14, and a vacuum remote assembly 16.

The housing 4 encloses the film delivery mechanism 6, the cutting mechanism 8, the conditioning assembly 10, the drive mechanism 12, the removable tray 14, and the vacuum remote assembly 16. The housing 4 includes a front housing member 18, a bottom housing member 20, a top housing member 22, first side housing member 24, second side housing member 26 and a back housing member 28. The front housing member 18 is disposed on a front side 30 of the automated food storage machine 1 and includes a control panel 32.

The control panel 32 is a user interface for controlling various functions of the food storage machine 1. The control panel 32 provides exteriorly exposed buttons 34 for access by the user. Within the housing 4, the control panel 32 can include a microcomputer with an operating control program that controls the evacuating, cutting, sealing and dispensing, as discussed herein. The control panel 32 can also include other conventional components such as a power circuit (not shown), an input interface circuit (not shown), an output interface circuit (not shown), and one or more storage devices (not shown), such as a ROM (Read Only Memory) device and a RAM (Random Access Memory) device. The power circuit is connected to an AC or DC power source and directs power to the motors, sensors, etc. described herein, as well as provide power to other circuits and components of the control panel 32. The input interface circuit can be electrically connected to the buttons 34 for user control. The output interface circuit can be electrically connected to a display (not shown), for example. The storage device stores processing results and control programs that are run by the processor circuit. The control panel 32 is capable of selectively controlling any of the cutting mechanism 8, the conditioning assembly 10 the drive mechanism 12 or the vacuum remote assembly 16 in accordance with the control program. It will be apparent to those skilled in the art from this disclosure that the precise structure and algorithms for the control panel 32 can be any combination of hardware and software that will carry out the functions of the present invention.

The front housing member 18 forms apertures of various sizes and shapes. Specifically, the front housing member 18 forms opening slot(s) 36, a remote cavity 38 and a receptacle (tray) cavity 40. The opening slot(s) 36 is/are elongated to receive a width of the bag material. The remote cavity 38 is formed by walls 42 that surround a portion of the vacuum remote assembly 16. An opening 44 of the cavity 38 provides access to a portion of the vacuum remote assembly 16. In the remote cavity 38, a remote stand 46 extends upwardly from a bottom surface 48. The remote stand 46 is configured and arranged to hold a portion of the vacuum remote assembly 16.

The receptacle cavity 40 is formed below the opening slot(s) 36. The receptacle cavity 40 is sized and configured to receive the removable tray 14. A portion of the removable tray 14 slides through the receptacle cavity 40 and rests underneath the conditioning assembly 10 for collection of waste (e.g. juices from food or solid food particulates separated during sealing and vacuuming).

The front housing member 18, the first and second side members 24, 26 and the back housing member 28 rest on the bottom housing member 20. The bottom housing member 20 is sized and configured to allow the food storage machine 1 to sit on a household countertop. The bottom housing member 20 has multiple rubber feet 50 to stabilize the food storage machine 1 and grip the countertop.

The top housing member 22 is disposed on a top side 52 of the food storage machine 1. At least a portion of the top housing member 22 acts as a door to the interior of the food storage machine 1. Specifically, the top housing member 22 includes a door section 54 that is pivotally disposed to provide access to the film delivery mechanism 6 for maintenance and cleaning, for example. The door section 54 is hingedly connected to the back housing member 28 via hinge 58 at a back portion 56 of the door section 54. The hingedly connected door section 54 pivots to provide access to the interior of the food storage machine 1. Other connections that provide pivoting action of the door member 54 may be used. The top housing member 22 or the door member 54 can include a latch (not shown) to secure a closed position of the door member 54.

Figure 2:
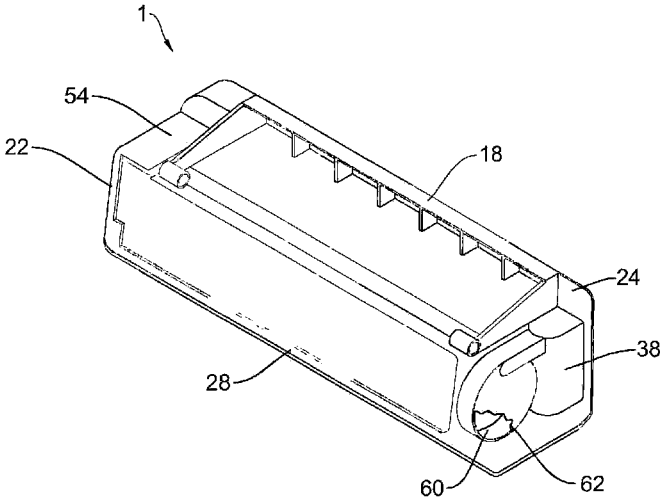
FIG. 2 is a rear perspective view of the food storage machine of FIG. 1 according to an embodiment of the present invention.

Referring to FIG. 2, the first side housing member 24 includes an inner cavity 60 that accommodates a portion of the vacuum remote assembly 16. It will be apparent to one of ordinary skill in the art from this disclosure that the remote cavity 38 can be provided as part of the side housing member 24, 26 rather than the front housing member 18.

The back housing member 28 is located at a back side 62 of the food storage machine 1. In this embodiment, the back housing member 28 and the side housing members 24, 26 are integrally formed with the top housing member 22 as a single unitary member. However, the back housing member 28 and the side housing members 24, 26 can be separate members that connect to each other or the top housing member 22.

Figure 3:
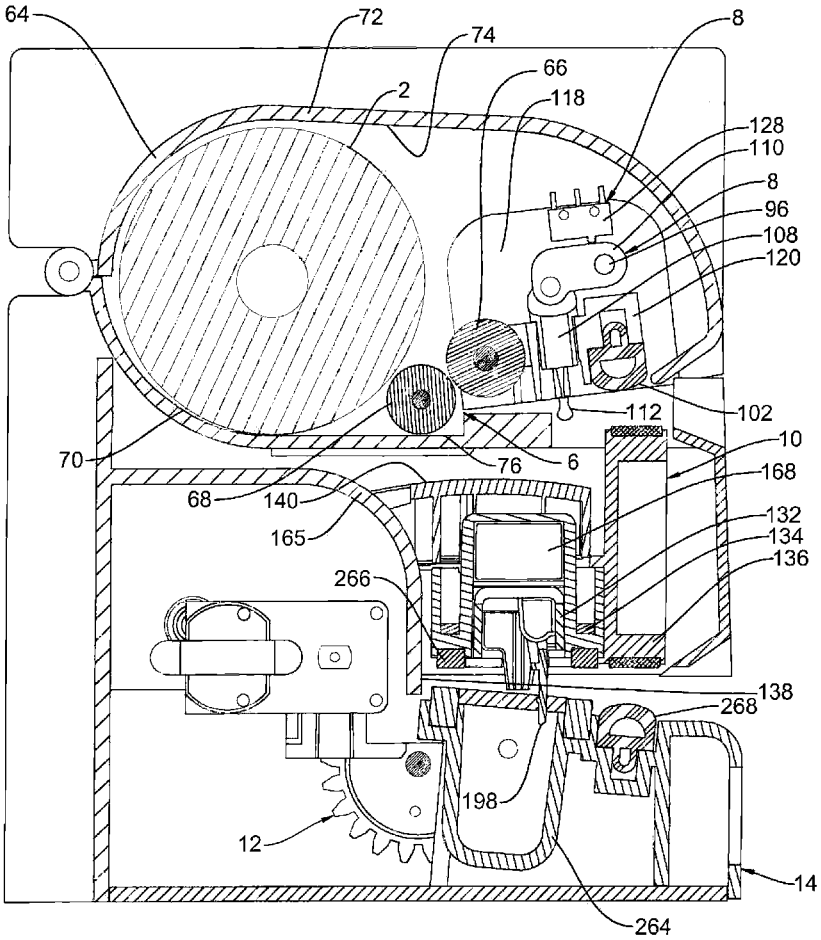
FIG. 3 is a side cross-sectional view of the food storage machine of FIG. 1 according to an embodiment of the present invention.
Figure 4:
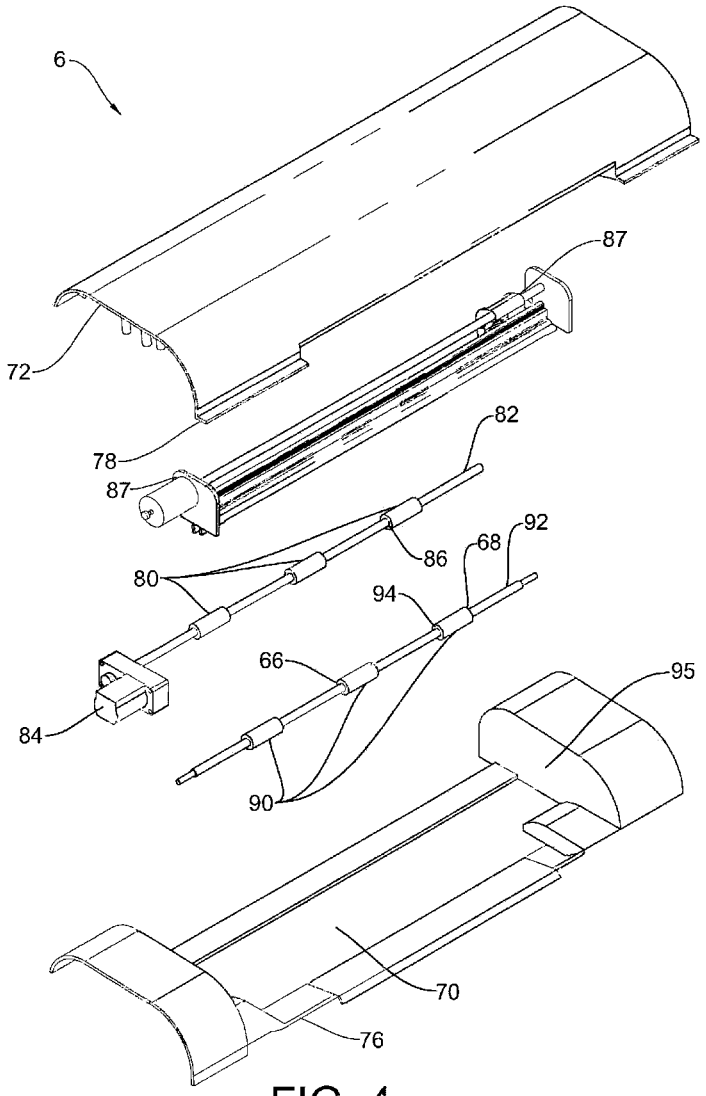
FIG. 4 is an exploded view of a film delivery mechanism of the food storage machine according to an embodiment of the present invention.

Referring to FIGS. 3 and 4, the film delivery mechanism 6 supports a roll of bag material 2 and dispenses or retracts the bag material 2. The film delivery mechanism 6 includes a roll compartment member 64, a feed roller assembly 66 and a free roller assembly 68. The roll compartment member 64 includes a contoured support cradle 70 for the roll of bag material 2 to rest thereon and a cradle cover 72. The cradle cover 72 is disposed at an inner face 74 of the door section 54.

The contoured support cradle 70 has an end portion that is a lower guide portion 76. The cradle cover 72 includes an end portion that is an upper guide portion 78. The lower and upper guide portions 76, 78 are spaced apart to form a space for the bag material 2 to slide therethrough.

The feed roller assembly 66 is attached to the cutting mechanism 6. Specifically, the feed roller assembly 66 is rotatably attached to the cutting mechanism 6 and disposed adjacent the free roller assembly 68. The feed roller assembly 66 includes multiple first rollers 80, a first shaft 82 and a motor 84. The first rollers 80 are generally tubular shaped with inner diameters 86 sized to receive the first shaft 82. The first shaft 82 extends through inner diameters 86 of the tubular first rollers 80 and attaches to the cradle cover 70 at apertures 87. The first rollers 80 are non-rotatable with respect to the first shaft 82. The first shaft 82 is disposed at the cradle cover 72 and is rotated by the motor 84. The motor 84 is electrically connected to the control panel 32. The motor 84 selectively rotates the first shaft 82 and first rollers 80 in a clockwise or counterclockwise direction. That is, the user can control the motor 84 to either dispense or retract the bag material 2 by rolling the roll and feeding the bag material 2 in a direction for dispensing or a direction for retracting. Specifically, one or more of the buttons 34 of the control panel 32 is communicatively connected to the motor 84 to control dispensing or retracting of the bag material 2 to control length of the bag material 2 dispensed.

The free roller assembly 68 is disposed at the lower guide portion 76 and includes multiple second rollers 90 and a second shaft 92. The second rollers 90 are generally tubular shaped with inner diameters 94 sized to receive the second shaft 92. The second shaft 92 extends through inner diameters 94 of the tubular second rollers 90 and attaches to the support cradle 70 at apertures 95. The second rollers 90 can be non-rotatable with respect to the second shaft 92, which is rotatably disposed at the lower guide portion 76. Alternatively, the second rollers 90 can be rotatable with respect to the second shaft 92, which is non-rotatably disposed at the lower guide portion 76. The free roller assembly 68 is disposed substantially parallel with the feed roller assembly 66. The free roller assembly 68 is located near the feed roller assembly 66 such that the first rollers 80 can lightly contact the second rollers 90 but spaced at a small distance to allow the bag material 2 to slide through the first and second rollers 80, 90. When the roll of bag material 2 is placed on the support cradle 70, a portion of the free end of the roll can be placed on the free roller assembly 68. The door section 54 is then closed, thereby positioning the feed roller assembly 66 on top of the bag material 2 and causing the first rollers 80 to engage the second rollers 90.

Figure 5:
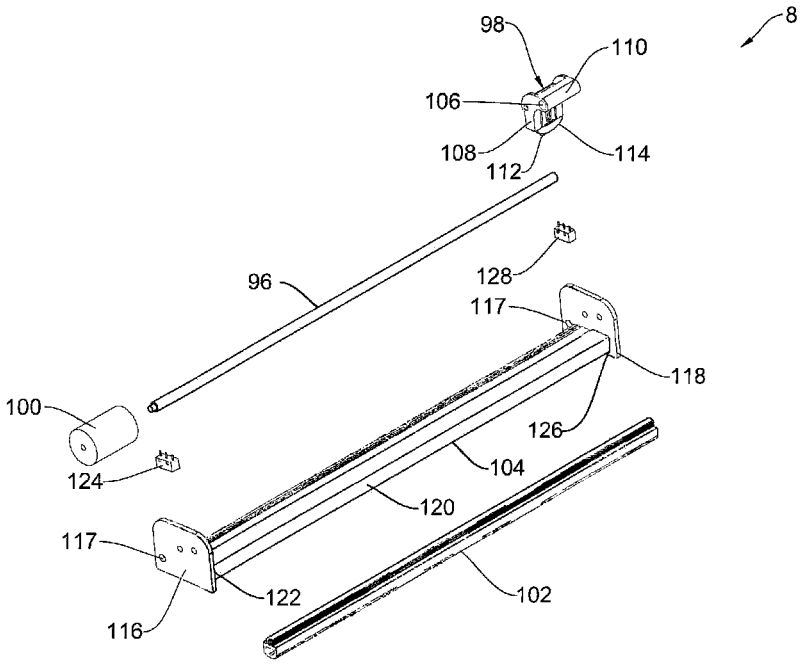
FIG. 5 is an exploded view of a cutting mechanism of the food storage machine according to an embodiment of the present invention.

Referring to FIGS. 3 and 5, the cutting mechanism 8 is disposed adjacent the support cradle 70 and is arranged to cut the bag material 2 transversely across when signaled via the control panel 32. The cutting mechanism 8 includes a threaded rod 96, a shuttle member 98, a motor 100, a first sealing bumper 102 and a cutting support member 104. The threaded rod 96 is a rotatable rod that is threaded through the shuttle member 98. The threaded rod 98 is a translation screw that moves the shuttle member 98 axially along the threaded rod 98 as the same threaded rod 96 rotates. The motor 100 rotates the threaded rod 96 and is electrically connected to the control panel 32. The threaded rod 96, the motor 100 and the first sealing bumper 102 are supported by the cutting support member 104.

The shuttle member 98 includes a threaded hole 106, a cutting portion 108 and a guide portion 110. The threaded hole 106 includes female threads for mating with the translation screw threads of the threaded rod 96. Specifically, the threaded rod 96 extends through the threaded hole 106 and rotates within the threaded hole 106 to move the shuttle member 98. The cutting portion 108 is attached to the guide portion 110 and extends downwardly. The cutting portion 108 is configured to cut the bag material 2 in either direction as the shuttle member 98 moves axially along the threaded rod 96. The cutting portion 108 includes a first blade 112 and a second blade 114. The first and second blades 112, 114 are angled from each other to ensure that the bag material 2 is cut regardless of the direction of travel of the shuttle member 98. The guide portion 110 extends away from the threaded rod 96 and the cutting portion 108. In this embodiment, the first and second blades 112, 114 face in opposite directions (180°) to allow cutting in either direction traversed by the shuttle member 98. The guide portion 110 is configured to slidably engage the cutting support member 104. The guide portion 110 is attached to the first sealing bumper 102 and secures it in place above the conditioning assembly 10.

The cutting support member 104 includes a first lateral support 116, a second lateral support 118 and a track support 120. The track support 120 is disposed between the first lateral support 116 and the second lateral support 118. The first and second lateral supports 116, 118 also support the first shaft 82 of the feed roller assembly 66. Specifically, the feed roller assembly 66 is located at lower apertures 117, 119 of the first and second lateral supports 116, 118. The first lateral support 116 is attached to a first end portion 122 of the track support 120 and includes a first microswitch 124 that is attached adjacent to the first end portion 122. The threaded rod 96 is located at upper apertures 121, 123 of the first and second lateral supports 116, 118. The motor 100 and its connection to the threaded rod 96 are supported by the first lateral support 116. The second lateral support 118 is attached to a second end portion 126 of the track support 120 and includes a second microswitch 128 that is attached adjacent to the second end portion 126. The first and second microswitches 124, 128 are electrically connected to the motor 100 and/or the control panel 32. The first and second microswitches 124, 128 are configured and arranged to sense the presence of the shuttle member 98 at the first or second end portions 122, 126, respectively. A signal is then sent to the motor 100 to stop rotation of the threaded rod 96. One or more of the buttons 34 of the control panel 32 is communicatively connected to the motor 100 to control cutting of the bag material 2. The movement of the shuttle member 118 may be initiated by pressing the button 34 to cut the bag material 2.

The threaded rod 96 is rotatably attached to the second lateral support 118. The track support 120 provides a track for the guide portion 110 to slide along so as to guide or slidably support the shuttle member 98 as it moves between the first and second lateral supports 116, 118. The first sealing bumper 102 and the track support 120 are disposed substantially parallel to the threaded rod 96. The first sealing bumper 102 is configured to dampen movement of the conditioning assembly 10 and is attached to the cutting support member 104 at the track support 120. Thus, an upper section of the track support 120 faces the shuttle member 98 and a lower section of the track support 120 holds the first sealing bumper 102.

Figure 6:
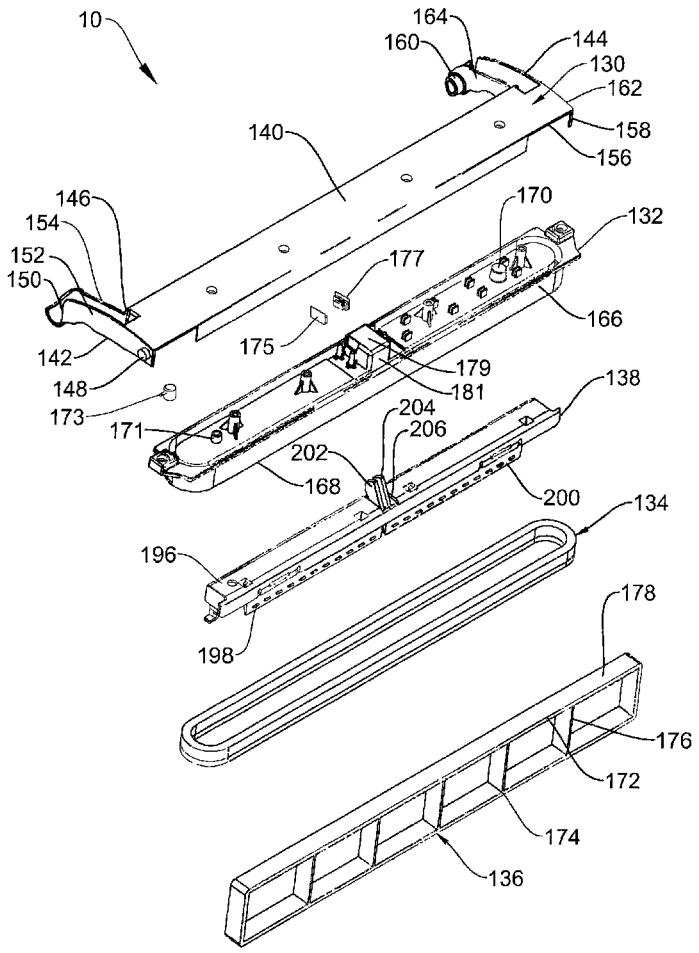
FIG. 6 is an exploded view of a conditioning mechanism of the food storage machine according to an embodiment of the present invention.

Referring to FIGS. 3 and 6, the conditioning assembly 10 includes a heater support member 130, a first vacuum chamber member 132, a first vacuum chamber seal 134, a heater member 136 and a sensor trigger member 138. The heater support member 130 is pivotably attached to the heater member 136 and connected to the first vacuum chamber member 132. The first vacuum chamber member 132 is attached at an under side of the heater support member 130. The first vacuum chamber seal 134 is attached to the first vacuum chamber member 132 and seals at least a portion of the first vacuum chamber member 132. The sensor trigger member 138 is disposed under the heater support member 130 and the first vacuum chamber member 132.

The heater support member 130 includes a beam portion 140, a first pivot arm 142 and a second pivot arm 144. The beam portion 140 is disposed between the first pivot arm 142 and the second pivot arm 144. The first pivot arm 142 is attached to a first end 146 of the beam portion 140. The first pivot arm 142 extends perpendicularly to the beam portion 140 and includes a first pivot pin 148 and a second pivot pin 150. The first pivot pin 148 is disposed at an exterior face 152 of the first pivot arm 142 adjacent the first end 146 and extends outwardly. The second pivot pin 150 is disposed at an opposite end of the first pivot arm 142 from the first pivot pin 148 at an interior face 154 of the first pivot arm 142. The second pivot pin 150 extends inwardly toward the second pivot arm 144.

The second pivot arm 144 is attached to a second end 156 of the beam portion 140. The second pivot arm 144 extends perpendicularly to the beam portion 140 and includes a third pivot pin 158 and a fourth pivot pin 160. The third pivot pin 158 is disposed at an exterior face 162 of the second pivot arm 144 adjacent the second end 156 and extends outwardly. The fourth pivot pin 160 is disposed at an opposite end of the second pivot arm 144 from the third pivot pin 158 at an interior face 164 of the second pivot arm 144. The fourth pivot pin 160 extends inwardly toward the first pivot arm 142.

The first pivot pin 148 and the third pivot pin 158 are attached to the drive mechanism 12. The second pivot pin 150 and the fourth pivot pin 160 are pivotally attached to an inner frame member 165 of the housing 4. The inner frame member 165 is a stationary member that provides a base, from which the conditioning assembly 10 pivots.

The first vacuum chamber member 132 includes pressure walls 166 surrounding a vacuum chamber 168 and a top portion 170. The top portion 170 is attached to the pressure walls 166 and forms the top of the vacuum chamber 168. The first vacuum chamber seal 134 engages an edge of the pressure walls 166, which form a lip around the vacuum chamber 168. The first vacuum chamber seal 134 encircles the lip around the vacuum chamber 168.

The top portion 170 mates with the beam portion 140 of the heater support member 130. The top portion 170 includes a vacuum port 171, a vacuum fitting 173, a first sensor 175, a second sensor 177 and a sensor upright portion 179. The vacuum port 171 is a vacuum opening extending through to the vacuum chamber 168. The vacuum fitting 173 fluidly connects with the vacuum port 171. The vacuum fitting 173 is fluidly connected to a vacuum source (not shown) via a conduit (not shown) and thus, connects the vacuum port 171 with the vacuum source. The first sensor 175 and the second sensor 177 are disposed adjacent the sensor upright portion 179 at respective opposite sides of the sensor upright portion 179. The sensor upright portion 179 is substantially transparent and forms a wing chamber 181, described below. In this embodiment, the first and second sensors 175, 177 are infrared sensors that project an infrared beam through the sensor upright portion 179 and through the wing chamber 181. Breaking of the beam by the sensor trigger member 138 causes the first or second sensor 175, 177 to signal the control panel 32 to start the vacuum source to begin evacuation of air from the bag material 2.

Figure 7:
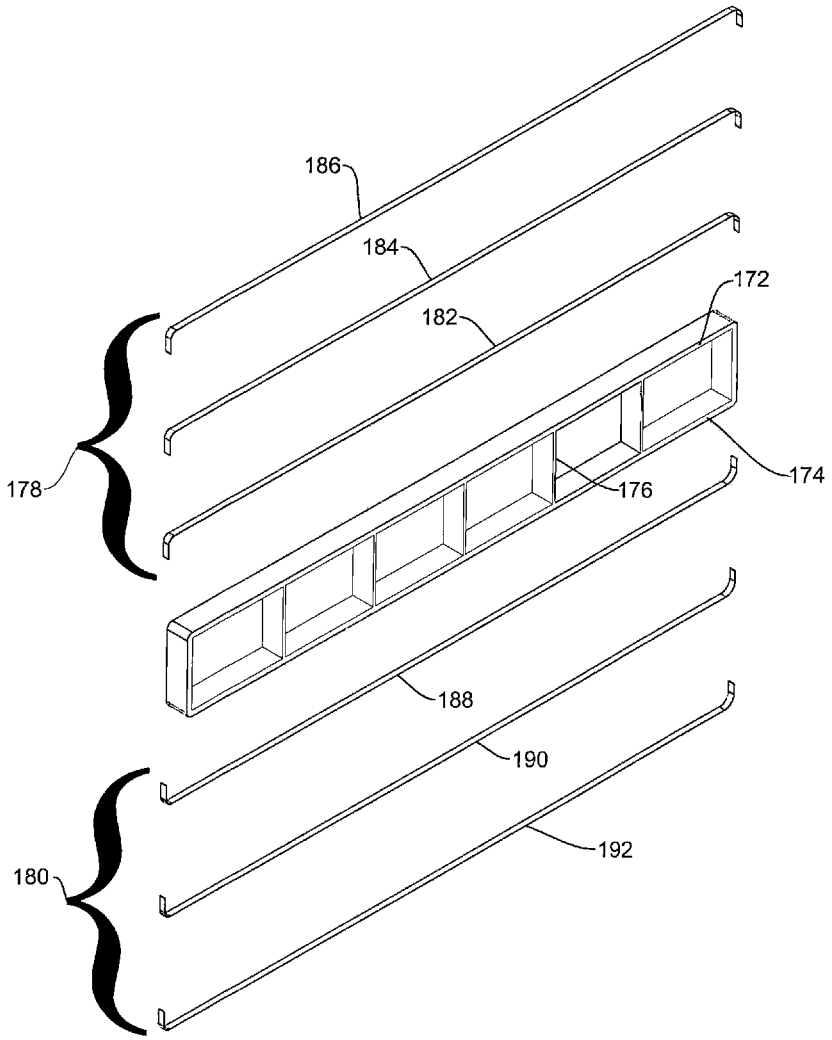
FIG. 7 is an exploded view of a heater member of the conditioning mechanism of FIG. 6 according to an embodiment of the present invention.

Referring to FIGS. 3, 6 and 7, the heater member 136 is a double-sided heater bar for applying heat to the bag material 2. The heater member 136 is pivotably attached to the beam portion 140. The heater member 136 includes a first bar portion 172, a second bar portion 174 and multiple strut portions 176. The first bar portion 172 is disposed substantially parallel to the second bar portion 174. The strut portions 176 are disposed between first bar portion 172 and the second bar portion 174. The strut portions 176 connect the first bar portion 172 and the second bar portion 174 together to form a one-piece, double-sided heater bar.

The first bar portion 172 includes a first strip heater assembly 178 and the second bar portion 174 includes a second strip heater assembly 180. The first and second strip heater assemblies 178, 180 are attached to an exterior of the respective first and second bar portions 174, 176 such that the first and second strip heater assemblies 178, 180 are oppositely facing.

The first strip heater assembly 178 has a first insulation strip 182, a first heat strip 184 and a first heat seal strip 186. The first insulation strip 182 is disposed between the first heat strip 184 and the first bar portion 172. The first heat strip 184 is electrically connected to the control panel 32 for selective heating of the bag material 2. The first heat seal strip 186 is disposed over the first heat strip 184 to ensure easy release from the bag material 2 after heating.

The second strip heater assembly 180 has a second insulation strip 188, a second heat strip 190 and a second heat seal strip 192. The second insulation strip 188 is disposed between the second heat strip 190 and the second bar portion 174. The second heat strip 190 is electrically connected to the control panel 32 for selective heating of the bag material 2. The second heat seal strip 192 is disposed over the second heat strip 190 to ensure easy release form the bag material 2 after heating.

The first and second insulation strips 182, 188 comprise one or more bands of mica, for example. The first and second heat seal strips 186, 192 comprise PTFE tape, for example. The PTFE tape can be Acrylic or Silicone PTFE tape, for example.

Referring to FIGS. 3 and 6, the sensor trigger member 138 includes a bar portion 196, a first partition portion 198 and a second partition portion 200. The first partition portion 198 and the second partition portion 200 are pivotally disposed in the bar portion 196. The first and second partition portions 198, 200 extend downwardly from the bar portion 196 and serve to partition an inner portion of the housing 4 from that portion exposed to the bottom slot 36*b*.

The first partition portion 198 has a first wing 202 extending upwardly at an angle. The second partition portion 200 has a second wing 204 extending upwardly at an angle. The first wing 202 is disposed adjacent the second wing 204. Furthermore, the bar portion 196 includes a wing aperture 206 that the first and second wings 202, 204 extend through. With the bar portion 196 disposed in the vacuum chamber 168, the first and second wings 202, 204 extend into the wing chamber 181. Thus, when the first and second partition portions 198, 200 are pivoted, by the bag material 2 for example, the first and second wings 202, 204 move within the wing chamber 181. The first sensor 175 and the second sensor 177 detect the movement of the first wing 202 and/or the second wing 204 and signal the control panel 32 accordingly.

Figure 8:
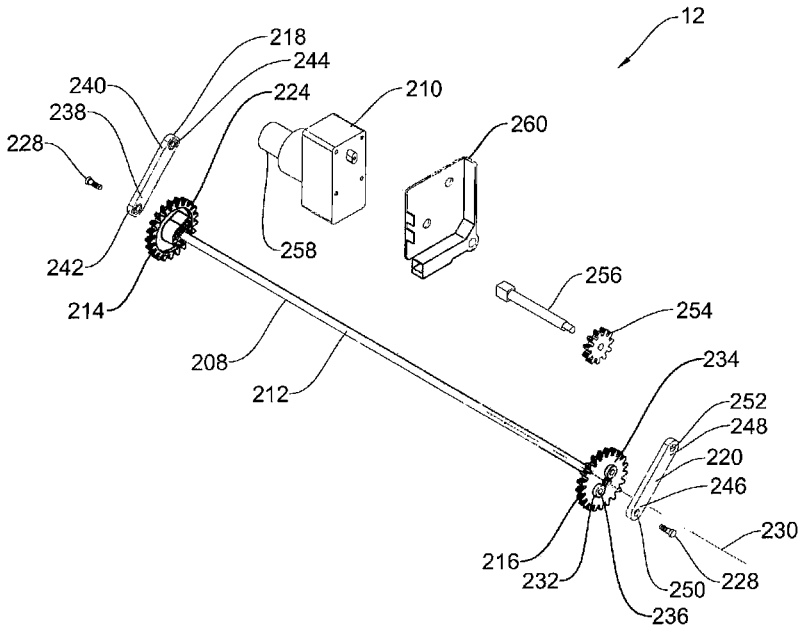
FIG. 8 is an exploded view of a drive mechanism of the food storage machine according to an embodiment of the present invention.

Referring to FIG. 8, the drive mechanism 12 includes a gear member 208 and a drive member 210. The gear member 208 is operatively connected to the drive member 210. Specifically, the drive member 210 drives the gear member 208 which in turn pivots the conditioning assembly 10.

The gear member 208 includes a torque rod 212, a first gear 214, a second gear 216, a first rotation arm 218 and a second rotation arm 220. The first gear 214 is attached to the torque rod 212 at one end and the second gear 216 is attached to the torque rod 212 at a second end opposite the first gear 214. The first gear 214 and the second gear 216 are non-rotatable with respect to the torque rod 212.

The first gear 214 is attached to the first rotation arm 218 and the second gear 216 is attached to the second rotation arm 220. The first gear 214 includes a first fastener base 222 extending perpendicularly from an exterior face 224 of the first gear 214. The first fastener base 222 is tubular shaped with a fastener aperture 226 sized to receive a fastener 228. The first fastener base 222 is located off-center from a center axis 230 of the first gear 214.

The second gear 216 includes a second fastener base 232 extending perpendicularly from an exterior face 234 of the second gear 216. The second fastener base 232 is tubular shaped with a fastener aperture 236 sized to receive the fastener 228. The second fastener base 232 is located off-center from the center axis 230 of the second gear 216.

The fastener apertures 226, 236 can have internal threads and the fastener 228 can have mating male threads. Alternatively, the fastener apertures 226, 236 can be sized to receive the fastener 228 with a friction fit.

The first rotation arm 218 is attached to the first gear 214 via the first fastener base 222 and the fastener 228. The first rotation arm 218 includes a first base end portion 238 and a first connection end portion 240. The first base end portion 238 has a first base fastener opening 242 and the first connection end portion 240 has a first connection fastener opening 244. The fastener 228, inserted through the first base fastener opening 242, secures the first base end portion 242 to the first gear 214. Rotation of the first gear 214 rotates the first rotation arm 218; however, the first rotation arm 218 is non-rotatable with respect to the first gear 214.

The second rotation arm 220 is attached to the second gear 216 via the second fastener base 232 and the fastener 228. The second rotation arm 220 includes a second base end portion 246 and a second connection end portion 248. The second base end portion 246 has a second base fastener opening 250 and the second connection end portion 248 has a second connection fastener opening 252. The fastener 228, inserted through the second base fastener opening 250, secures the second base end portion 246 to the second gear 216. Rotation of the second gear 216 rotates the second rotation arm 220; however, the second rotation arm 220 is non-rotatable with respect to the second gear 216.

The first and second connection end portions 240, 248 are connected to the conditioning assembly 10. Specifically, the first pin 148 is pivotally disposed within the first connection fastener opening 244 and the third pin 158 is pivotally disposed within the second connection fastener opening 252.

The drive member 210 engages the first gear 214 to rotate the torque rod 212, the first gear 214, the second gear 216, the first rotation arm 218 and the second rotation arm 220. The drive member 210 includes a drive gear 254, a drive shaft 256, a gear motor 258 and a bulk head portion 260. The drive gear 254 is non-rotatably attached to the drive shaft 256. The drive shaft 256 is attached to the gear motor 258. The bulk head portion 260 supports the drive shaft 256 and/or the gear motor 258. The gear motor 258 is electrically connected to the control panel 32.

The drive gear 254 has teeth that mesh with teeth of the first gear 214 to transmit torque from the gear motor 258 and drive shaft 256 so as to rotate the gear member 208.

Figure 9:
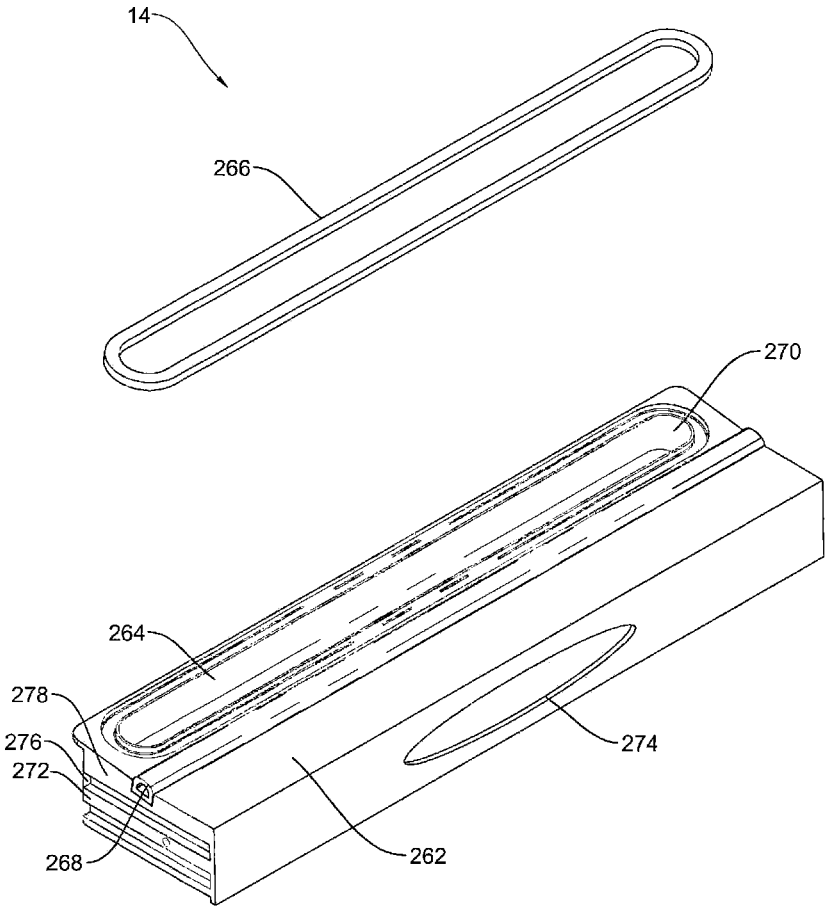
FIG. 9 is an exploded view of a removable tray of the food storage machine according to an embodiment of the present invention.

Referring to FIG. 9, the removable tray 14 includes a tray member 262, a second vacuum chamber member 264, a second vacuum chamber seal 266, a second sealing bumper 268 and one or more liquid sensors 270. The tray member 262 is configured to fit within the receptacle cavity 40 of the front housing member 18. The second vacuum chamber member 264 and the second sealing bumper 266 are set within the tray member 262. The liquid sensors 270 are disposed at the second vacuum chamber member 264 and are electrically connected to the control panel 32 to signal an excessive accumulation of liquid in the second vacuum chamber member 264. The second vacuum chamber seal 266 is attached to the second vacuum chamber member 264 and seals at least a portion of the second vacuum chamber member 264. The second vacuum chamber seal 266 encircles the lip around the second vacuum chamber member 264.

The tray member 262 includes at least one guide insert 272, a finger hollow 274 and a contact head 276. The guide insert 272 is disposed at a first side 278 of the tray member 262. The guide insert 272 is a protrusion shaped to fit within a track (not shown) of the receptacle cavity 40, thereby guiding the tray member 262 as it slides into or out of the receptacle cavity 40. The finger hollow 274 is an opening at a front face 280 of the tray member 262. The finger hollow 274 is sized and configured for one or more fingers of a user to grasp and pull the tray member 262 out of the receptacle cavity 40. The contact head 276 is disposed at the first side 278 of the tray member 262. The contact head 276 is positioned to contact a switch or sensor (not shown) when the tray member 262 is fully inserted into the receptacle cavity 40. Upon contact, the switch or sensor signals the control panel 32 that normal operations of the food storage machine 1 can begin.

Figure 10:
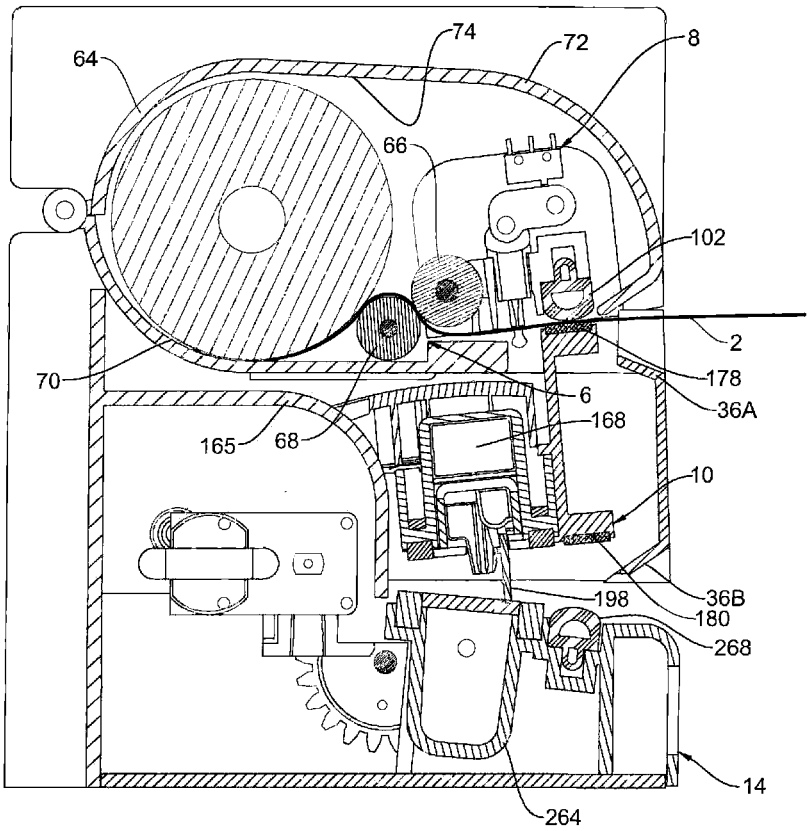
FIG. 10 is a side cross sectional view of the food storage machine with the conditioning assembly rotated in an upward position according to an embodiment of the present invention.
Figure 11:
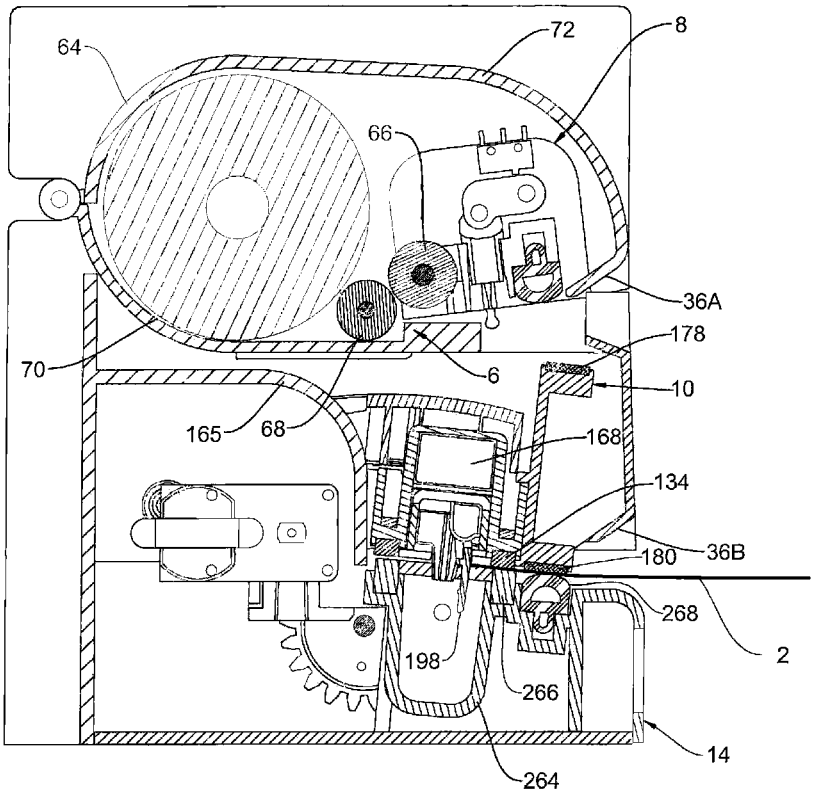
FIG. 11 is a side cross sectional view of the food storage machine with the conditioning assembly rotated in a downward position according to an embodiment of the present invention.

Referring to FIGS. 3, 10 and 11, in operation, the food storage machine 1 dispenses the bag material 2 from the roll with the film delivery mechanism 6 by feeding the bag material 2 between the feed roller assembly 66 and the free roller assembly 68. The feed roller assembly 66 engages the free roller assembly 68 and the bag material 2. The feed roller assembly 66, powered by the motor 84, rotates so as to pull the bag material 2 and also rotates the free roller assembly 68 along with the roll of bag material 2.

The feed roller assembly 66 feeds the bag material 2 into the cutting mechanism 8. The motor 100, operatively controlled by the control panel 32, moves the shuttle member 98 substantially longitudinally across food storage machine 1, i.e., transversely across the bag material 2. The blades 112 or 114 cut the bag material 2. The motor 100 can stop moving the shuttle member 98 when the first or second microswitch 124, 128 signal the presence of the shuttle member 98 at the first or second end portions 122, 126. At substantially the same time, the conditioning assembly 10 pivots upwardly to seal the bag material 2.

The first strip heater assembly 178 of the conditioning assembly 10 is heated (e.g. 160° C.-200° C.) to melt a portion of the bag material 2. The conditioning assembly 10 pivots to an upper position, where the first sealing bumper 102 meets the first strip heater assembly 178. The conditioning assembly 10 applies pressure to the first sealing bumper 102 with the first strip heater assembly 178 to clasp a portion of the bag material 2. The portion of the bag material 2 that is clasped between the first sealing bumper 102 and the first strip heater assembly 178 is melted to form a seal. The cut and sealed bag material 2 then slides out of the top slot 36*a*. The drive mechanism 12 pivots the conditioning assembly 10 and can be controlled by the control panel 32.

After the bag material 2 that was cut and sealed is filled with food products, for example, it can be inserted into the bottom slot 36*b*. As the bag material 2 slides through the slot 36*b*, it contacts the first partition portion 198 and/or the second partition portion 200 and causes one or more of the partition portions 198, 200 to pivot. Pivoting of the first and/or second partition portions 198, 200 causes movement of the respective wings 202, 204 in the wing chamber 181. Movement in the wing chamber 181 is sensed by the first and/or second sensors 175, 177, which can then trigger a suction source (not shown) to begin a vacuum. The first and/or second sensors 175, 177 can trigger the drive mechanism 12 to pivot the conditioning assembly 10 downwardly toward the removable tray 14. At a downward pivot position of the conditioning assembly 10, the second strip heater assembly 180 contacts the second sealing bumper 268 and the first vacuum chamber seal 134 contacts the second vacuum chamber seal 266, thereby sealing the first and second vacuum chamber members 132, 264 with a portion of the bag material 2 therebetween. Air in within the layers of the bag material is drawn out by the first and second vacuum chamber members 132, 264.

The second strip heater assembly 180 of the conditioning assembly 10 is heated (e.g. 160° C.-200° C.) to melt a portion of the bag material 2. The conditioning assembly 10 pivots downwardly to a lower position, where the second sealing bumper 268 meets the second strip heater assembly 180. The conditioning assembly 10 applies pressure to the second sealing bumper 268 with the second strip heater assembly 180 to clasp a portion of the bag material 2. The portion of the bag material 2 that is clasped between the second strip heater assembly 180 and the second sealing bumper 268 is melted to form a seal. The sealed bag material 2 can then be withdrawn from the bottom slot 36*b*.

Figure 12:
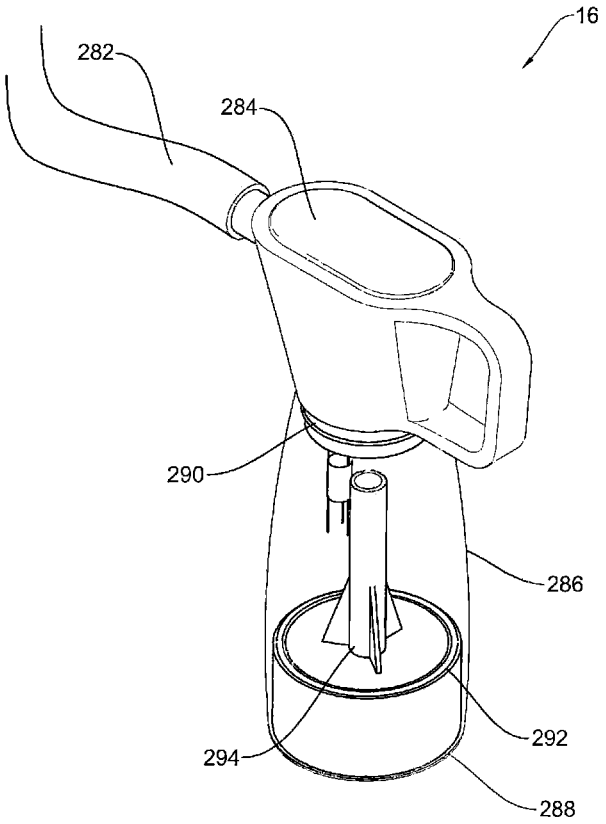
FIG. 12 is a perspective view of a vacuum remote assembly of the food storage machine according to an embodiment of the present invention.
Figure 13:
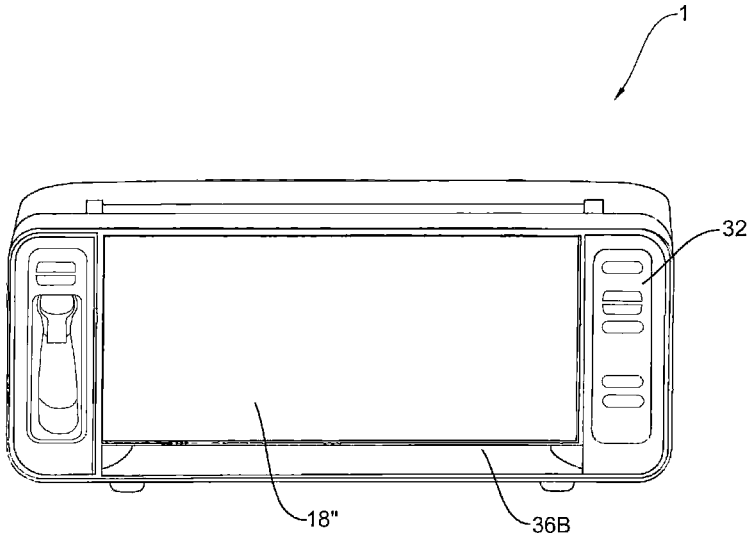
FIG. 13 is a front perspective view of a food storage machine according to a second embodiment of the present invention.
Figure 14:
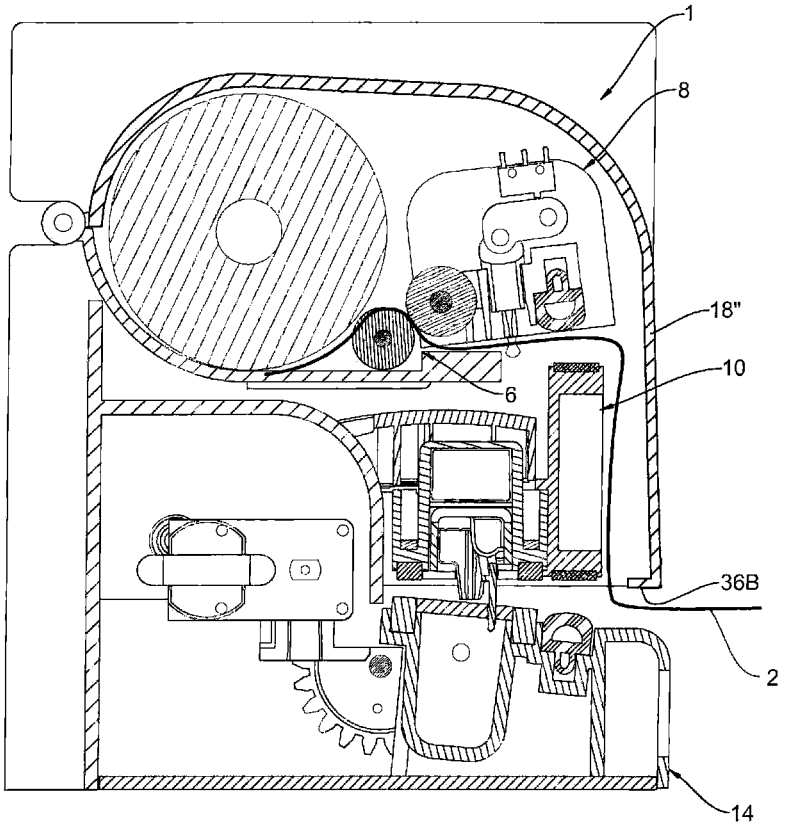
FIG. 14 is a side cross sectional view of the food storage machine of FIG. 13 with the conditioning assembly rotated in a center position according to the second embodiment of the present invention.
Figure 15:
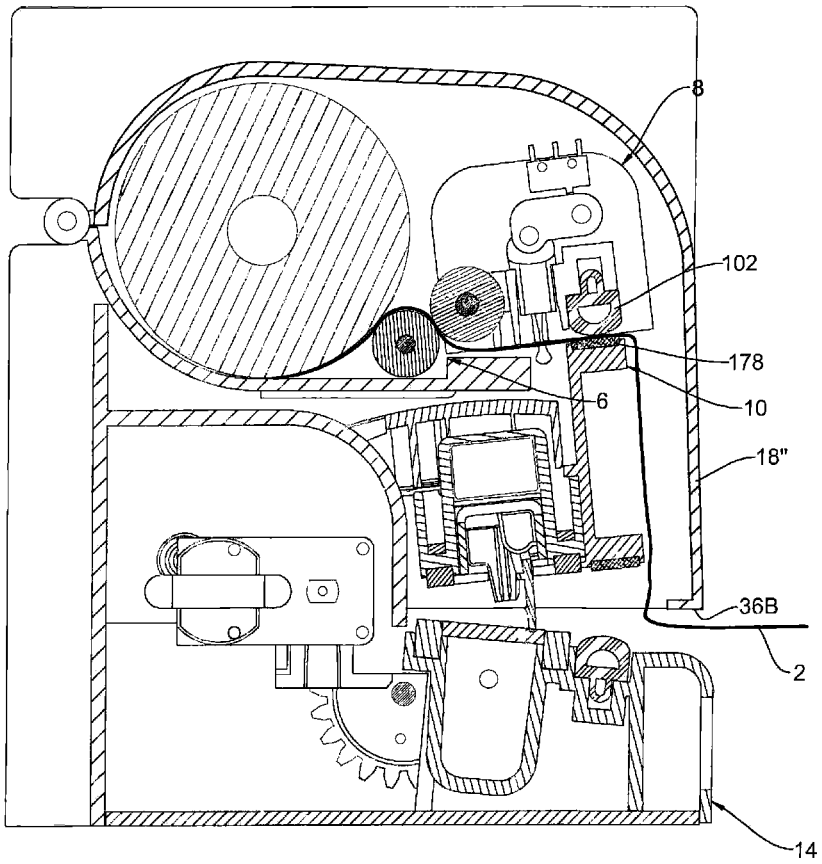
FIG. 15 is a side cross sectional view of the food storage machine with the conditioning assembly rotated in an upward position according to the second embodiment of the present invention.
Figure 16:
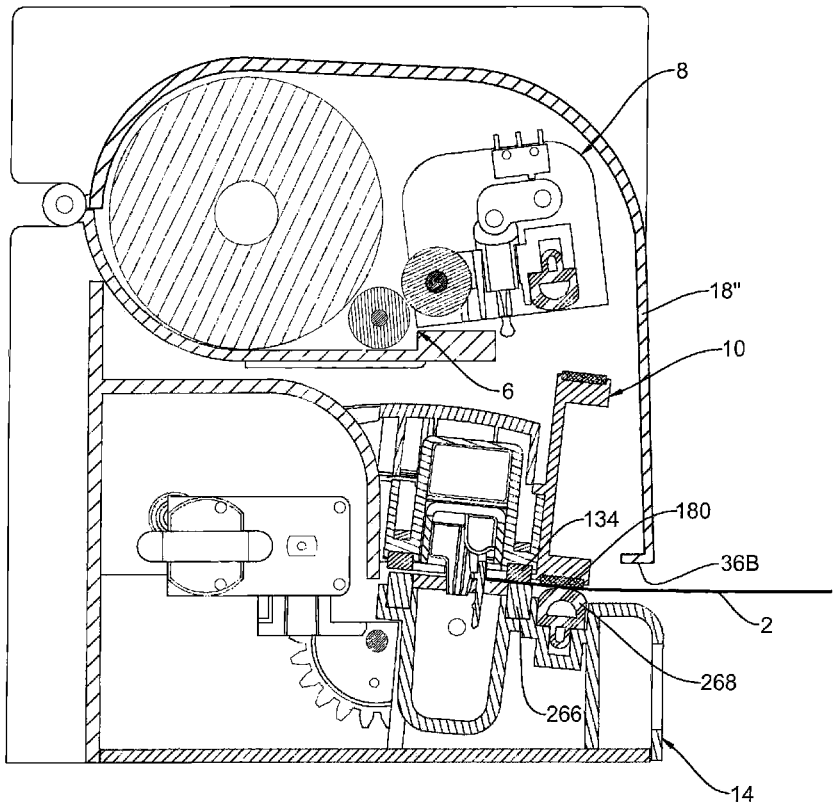
FIG. 16 is a side cross sectional view of the food storage machine with the conditioning assembly rotated in a downward position according to the second embodiment of the present invention.

Referring to FIGS. 1, 2 and 12, the vacuum remote assembly 16 is located at a side of the food storage machine 1. The vacuum remote assembly 16 may be removed from the housing 4 and can engage receptacles for vacuuming air out of the confines of the receptacle. The vacuum remote assembly 16 includes a retracting member (not shown), a hose member 282, a nozzle member 284 and an adapter member 286. The retracting member is disposed in the inner cavity 60 of the housing 4. The retracting member is common in the art and will not be discussed in detail herein. The hose member 282 is coiled around the retracting member and is retracted by the retracting member. Thus, the hose member 282 is stored or coiled in the inner cavity 60. The hose member 282 is connected to the vacuum source at one end and connected to the nozzle member 284 at the other end.

The nozzle member 284 and the adapter member 286 are removably disposed in the remote cavity 38. The nozzle member 284 can be directly connected to a receptacle or can be connected to the adapter member 286. The adapter member 286 is a tubular member and includes an inlet portion 288 and an outlet portion 290. The inlet portion 288 is disposed on a distal end portion 292 of the adapter member 286 opposite the outlet portion 290. The inlet 288 can mate with the remote stand 46 in the remote cavity 38. The inlet portion 288 is configured and arranged to mate with a nipple (not shown) of a receptacle or plastic bag, for example. Specifically, the inlet portion 288 can connect to canisters, containers and zipper bags, for example. The adapter member 286 includes a valve 294 for a pulsing vacuum. The valve 294 aids in a marinating process of foods within the canisters, containers and zipper bags.

The vacuum source is electrically connected to the control panel 32. One or more of the buttons 34 of the control panel 32 is communicatively connected to the vacuum source. For example, one of the buttons 34 may control starting and stopping the vacuum source while another one of the buttons 34 may control starting a pulsing vacuum and stopping the pulsing vacuum.

Second Embodiment

Referring now to FIGS. 13-16, a food storage machine 1 in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity. The parts of the second embodiment that differ from the parts of the first embodiment will be indicated with a double prime (").

The housing 4 includes a front housing member 18" having the slot 36*b* formed therethrough. The slot 36*b* is utilized to both dispense the bag material 2 and to vacuum seal the bag material 2.

In regards to dispensing, The first strip heater assembly 178 of the conditioning assembly 10 is heated (e.g. 160° C.-200° C.) to melt a portion of the bag material 2. The conditioning assembly 10 pivots until the first sealing bumper 102 meets the first strip heater assembly 178. The portion of the bag material 2 that is clasped between the first sealing bumper 102 and the first strip heater assembly 178 is melted to form a seal. The cut and sealed bag material 2 then slides downwardly along the inside of the front housing member 18" and out of the bottom slot 36*b*.

In regards to the vacuum sealing, the bag material 2 is inserted into the bottom slot 36*b*. Air is drawn out of the bag material 2 and the bag material 2 is sealed as describe above for the first embodiment.

Third Embodiment

Figure 17:
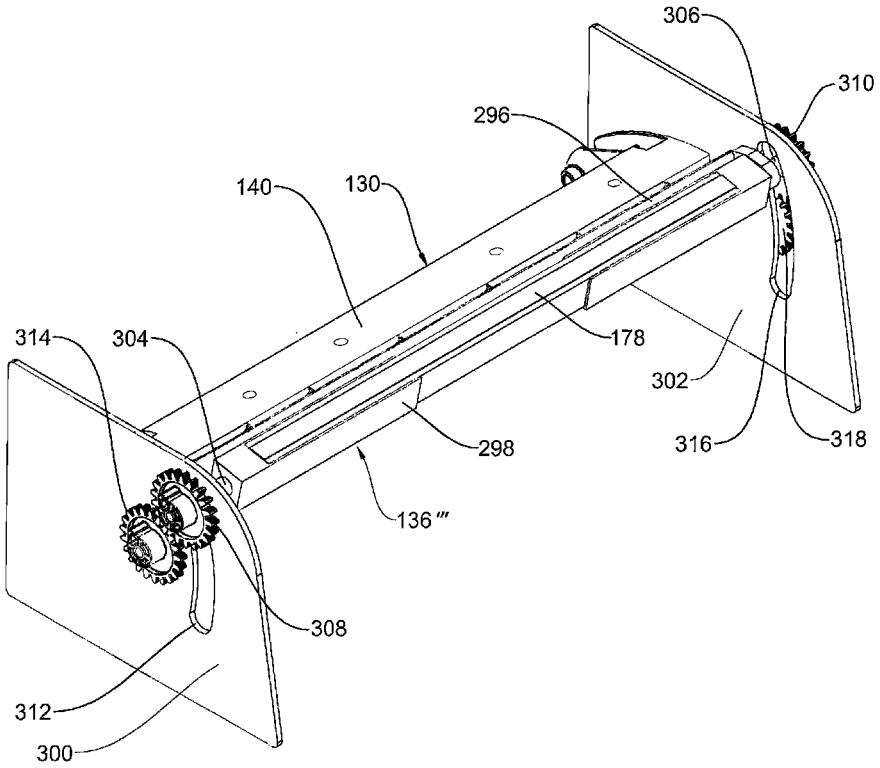
FIG. 17 is a front perspective view of a heater member of a food storage machine in an upward position according to a third embodiment of the present invention.
Figure 18:
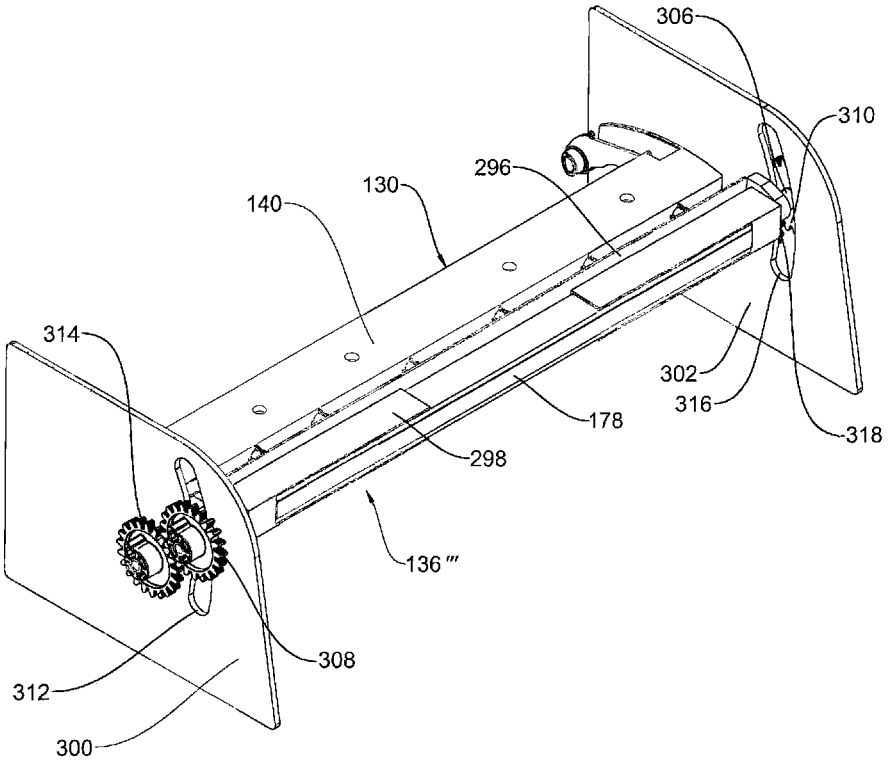
FIG. 18 is a front perspective view of the heater member of FIG. 17 in a center position according to the third embodiment of the present invention.
Figure 19:
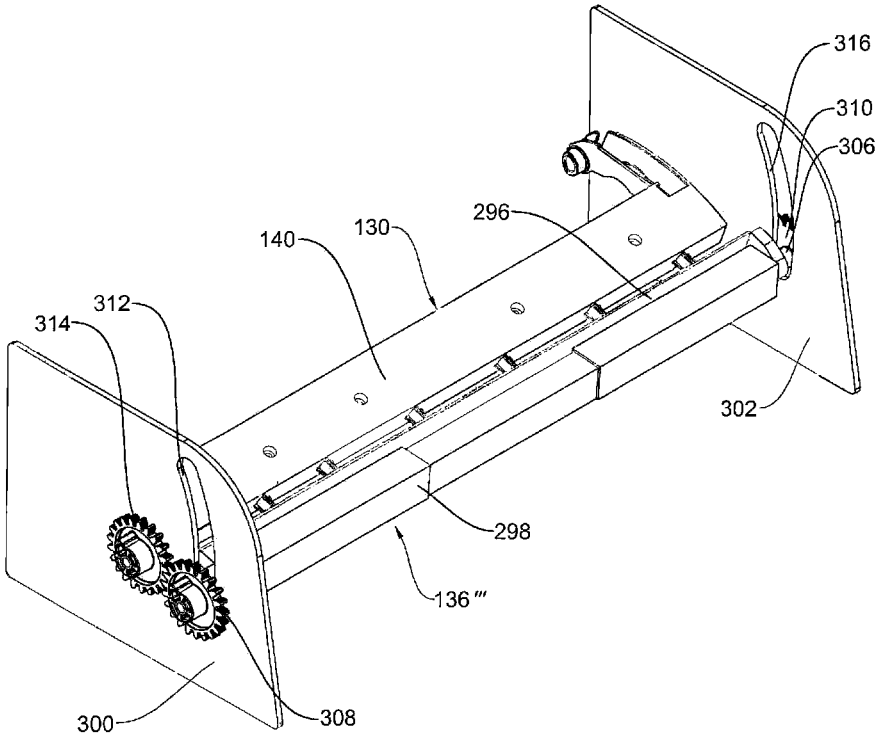
FIG. 19 is a front perspective view of the heater member of FIG. 17 in a downward position according to the third embodiment of the present invention.

Referring now to FIGS. 17-19, a heater member 136''' of the food storage machine 1 in accordance with a third embodiment will now be explained. In view of the similarity between the first and third embodiments, the parts of the third embodiment that are identical to the parts of the first embodiment will be given the same reference numerals as the parts of the first embodiment. Moreover, the descriptions of the parts of the third embodiment that are identical to the parts of the first embodiment may be omitted for the sake of brevity. The parts of the third embodiment that differ from the parts of the first embodiment will be indicated with a triple prime (''').

As the drive mechanism 12 pivots the support member 130, the heater member 136''' rotates approximately 180°. The heater member 136''' includes a rotation support portion 296, a rotation bar portion 298, a first guide post 300 and a second guide post 302. The rotation support portion 296 is attached to the beam portion 140 and supports the bar portion 298. The rotation bar portion 298 is rotatably attached to the rotation support portion 296. The rotation bar portion 298 engages first and second guide posts 300 and 302, which guide the rotation bar portion 298 as it rotates upwardly and downwardly.

The rotation bar portion 298 has a first strip heater assembly 178 on a face that rotates approximately 180°. The rotation bar portion 298 includes a first end portion 304 and a second end portion 306, which are inserted into the first and second guide posts 300, 302, respectively. The first end portion 304 is non-rotatably attached to a gear 308. The second end portion 306 is non-rotatably attached to a gear 310.

The first guide portion 300 includes a guide slot 312 and a gear 314. The second guide portion 302 includes a guide slot 316 and a gear 318. The first end portion 304, inserted in the guide slot 312, slides upwardly and downwardly within the guide slot 312. The gear 308 engages the gear 314 of the first guide portion 300 as the first end portion 304 slides within the guide slot 312. The second end portion 306, inserted in the guide slot 316, slides upwardly and downwardly within the guide slot 316. The gear 310 engages the gear 318 of the second guide portion 302 as the second end portion 306 slides within the guide slot 316.

Meshing of the teeth of the gears 308, 310 and 314, 318 causes the rotation bar portion 298 to rotate as it slides upwardly or downwardly in the guide slots 312, 316. Thus, the rotation bar portion 298 is configured to rotate as the heater support member 130 with the heater member 136''' pivots upwardly or downwardly.

In FIG. 17, the first strip heater assembly 178 is positioned upwardly so as to engage the first seal bumper 102. The end portions 304, 306 are located at the top of the guide slots 308, 310.

In FIG. 18, the first strip heater assembly 178 faces forwardly toward an inner face of the front housing member 18, 18". The end portions 304, 306 are located at the approximate middle of the guide slots 308, 310.

In FIG. 19, the first strip heater assembly 178 is positioned downwardly so as to engage the second seal bumper 268. The end portions 304, 306 are located at the bottom of the guide slots 308, 310.

General Interpretation of Terms

In understanding the scope of the present invention, the term "comprising" and its derivatives, as used herein, are intended to be open ended terms that specify the presence of the stated features, elements, components, groups, and/or steps, but do not exclude the presence of other unstated features, elements, components, groups, and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the present invention, any directional terms such as "forward, rearward, above, downward, upward, vertical, horizontal, below and transverse" as well as any other similar directional terms refer to those directions of an appliance equipped with the present invention as it sits for use on a household countertop. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Thus, the foregoing descriptions of the embodiments according to the present invention are provided for illustration only, and not for the purpose of limiting the invention as defined by the appended claims and their equivalents.

What is claimed is:

1. A food storage machine comprising:

a film delivery mechanism having a support cradle for a roll of bag material and a feed roller assembly for dispensing the bag material, the feed roller assembly being disposed adjacent the support cradle;

a cutting mechanism disposed adjacent the film delivery mechanism and having a first sealing bumper and a shuttle member with a cutting portion, the shuttle member being arranged to cut transversely across the bag material dispensed from the film delivery mechanism;

a conditioning assembly pivotably disposed below the film delivery mechanism and having a heater member for sealing a portion of the bag material; and a drive mechanism operatively connected to the conditioning assembly and configured to pivot upwards to contact the first sealing bumper of the cutting mechanism and to pivot downwards to contact a second sealing bumper.

2. The food storage machine of claim 1, further comprising a housing enclosing the film delivery mechanism, the cutting mechanism, the conditioning assembly and the drive mechanism, the housing including a front housing member with a top slot for dispensing bag material from the cutting mechanism and a bottom slot for receiving dispensed bag material.

3. The food storage machine of claim 2, wherein the top slot is substantially aligned with bag material dispensed form the roll of bag material.

4. The food storage machine of claim 1, further comprising a housing enclosing the film delivery mechanism, the cutting mechanism, the conditioning assembly and the drive mechanism, the housing including a front housing member with a bottom slot formed therein.

5. The food storage machine of claim 1, wherein the film delivery mechanism includes a cradle cover for covering the roll of bag material, and the cradle cover is disposed adjacent the feed roller assembly.

6. The food storage machine of claim 5, wherein the housing includes a top housing member with a door section, and the cradle cover is disposed on an inner side of the door section.

7. The food storage machine of claim 1, wherein the film delivery mechanism includes a free roller assembly to guide the bag material as it is dispensed from the roll.

8. The food storage machine of claim 7, wherein the free roller assembly is disposed so as to contact the roll of bag material.

9. The food storage machine of claim 1, wherein the feed roller assembly includes a motor, a rod, and a plurality of rollers disposed on the rod, and the rollers are configured and arranged to rotate with the rod to dispense or retract the bag material.

10. The food machine of claim 9, further comprising a control panel with buttons, at least one of the buttons being communicatively connected to the motor to control dispensing or retracting of the bag material to control length of the bag material dispensed.

11. The food storage machine of claim 1, wherein the cutting mechanism includes a motor, a threaded rod extending through the shuttle member and a cutting support member, the threaded rod is rotatably disposed at the cutting support member and the motor is connected to the threaded rod, and the threaded rod has threads that translate rotation into axial movement of the shuttle member.

12. The food storage machine of claim 11, wherein the axial movement of the shuttle member moves the cutting portion transversely across the bag material.

13. The food storage machine of claim 11, further comprising a control panel with buttons, at least one of the buttons being communicatively connected to the motor to control cutting of the bag material.

14. The food storage machine of claim 13, wherein at least one of the buttons on the control panel controls the motor by signaling to initiate cutting of the bag material.

15. The food storage machine of claim 1, wherein the conditioning assembly includes a first vacuum chamber member having one or more sensors and a sensor trigger member configured to trigger the one or more sensors when the bag material moves a portion of the sensor trigger member.

16. The food storage machine of claim 1, wherein the heater member has a first bar portion and a second bar portion disposed substantially parallel to the first bar portion, the first bar portion has a first strip heater assembly and the second bar portion has a second strip heater assembly.

17. The food storage machine of claim 16, wherein the first and second strip heater assemblies are attached to an exterior of the respective first and second bar portions such that the first and second strip heater assemblies are oppositely facing.

18. The food storage machine of claim 1, wherein the heater member includes a rotation bar portion and the rotation bar portion is configured to rotate as the drive member pivots the conditioning assembly upwardly or downwardly.

* * * * *